US010051721B2

(12) United States Patent
Lombardi et al.

(10) Patent No.: US 10,051,721 B2
(45) Date of Patent: Aug. 14, 2018

(54) HIGH FREQUENCY COMPACT LOW-ENERGY LINEAR ACCELERATOR DESIGN

(71) Applicant: CERN EUROPEAN ORGANIZATION FOR NUCLEAR RESEARCH, Geneva (CH)

(72) Inventors: Alessandra Lombardi, Geneva (CH); Maurizio Vretenar, Plan-les-Ouates (CH); Serge Mathot, Thoiry (FR); Alexej Grudiev, Duillier (CH)

(73) Assignee: CERN—EUROPEAN ORGANIZATION FOR NUCLEAR RESEARCH (CH)

( * ) Notice: Subject to any disclaimer, the term of this patent is extended or adjusted under 35 U.S.C. 154(b) by 10 days.

(21) Appl. No.: 15/503,895

(22) PCT Filed: Aug. 15, 2014

(86) PCT No.: PCT/EP2014/067512
§ 371 (c)(1),
(2) Date: Feb. 14, 2017

(87) PCT Pub. No.: WO2016/023597
PCT Pub. Date: Feb. 18, 2016

(65) Prior Publication Data

US 2017/0238408 A1 Aug. 17, 2017

(51) Int. Cl.

| | |
|---|---|
| ***H05H 7/04*** | (2006.01) |
| ***H05H 9/04*** | (2006.01) |
| ***H05H 7/18*** | (2006.01) |

(52) U.S. Cl.
CPC ..... *H05H 9/045* (2013.01); *H05H 7/04* (2013.01); *H05H 7/18* (2013.01); *H05H 2007/041* (2013.01); *H05H 2277/00* (2013.01)

(58) Field of Classification Search
CPC ..... H05H 9/045; H05H 7/04; H05H 7/18; H05H 2007/041; H05H 2277/00
USPC ..... 315/501–505, 39.55, 111.01, 111.61
See application file for complete search history.

(56) References Cited

U.S. PATENT DOCUMENTS 7,098,615 B2 * 8/2006 Swenson ..... H05H 7/22 315/505

OTHER PUBLICATIONS

Dehen, J., et al., Transport of Ions in a RFQ Accelerator, Proceedings of EPAC 1992, Institut für Angewandte Physik, 1992, pp. 967-969, XP002737726, D-6000 Frankfurt am Main, Fed. Rep. of Germany.
International Search Report for Application No. PCT/EP2014/067512 dated Apr. 9, 2015.

(Continued)

*Primary Examiner* — Jimmy Vu
(74) *Attorney, Agent, or Firm* — Lerner, David, Littenberg, Krumholz & Mentlik, LLP

(57) ABSTRACT

A compact radio-frequency quadrupole 'RFQ' accelerator for accelerating charged particles, the RFQ accelerator comprising: a bunching section configured to have a narrow radio-frequency 'rf' acceptance such that only a portion of a particle beam incident on the bunching section is captured, and wherein the bunching section bunches the portion of the particle beam; an accelerating section for accelerating the bunched portion of the particle beam to an output energy; and, a means for supplying radio-frequency power.

17 Claims, 13 Drawing Sheets

(56) References Cited

OTHER PUBLICATIONS

Koscielniak, S. et al., Beam Dynamics Studies on the ISAC RFQ at the TRIUMF, Proceedings of the PAC 1997, pp. 1102-1104, XP002737728, Vancouver, B.C., Canada.
Laxdal, R.E. et al., Beam Test Results with the ISAC 35 MHZ RFQ, Proceedings of the 1999 Particle Accelerator Conference, pp. 3534-3536, XP002737727, New York, United States.
Rossi, C. et al., The Radiofrequency Quadrupole Accelerator for the LINAC4, Proceedings of LINAC08, 2008, pp. 157-159, XP002737729, Victoria, BC, Canada.
Schempp, A., Design of Compact RFQS, Proceedings of LINAC96, Institut für Angewandte Physik, 1996, pp. 53-55, XP002737730, Johann Wolfgang Guethe-Universitat, D-60054 Frankfurt am Main, Germany.
Zhao, Q. et al, Design of Improvement of the RIA 80.5 MHZ RFQ, Proceedings fof LINAC 2004, pp. 599-601, XP002737725, Lübeck, Germany.

* cited by examiner

HIGH FREQUENCY COMPACT LOW-ENERGY LINEAR ACCELERATOR DESIGN

CROSS-REFERENCE TO RELATED APPLICATION

This application is a national phase entry under 35 U.S.C. § 371 of International Application No. PCT/EP2014/067512, filed on Aug. 15, 2014, published in English, the disclosure of which is incorporated herein by reference.

FIELD OF THE TECHNOLOGY

The present disclosure relates generally to the field of particle accelerators, and more particularly, to linear accelerators which utilise radio-frequency quadrupole (RFQ) cavities for bunching, focusing and accelerating charged particles.

BACKGROUND

The radio-frequency quadrupole linear accelerator design was first conceived in the 1970's and was initially presented as the 'missing link' towards high power beams. The early designs of RFQs allowed an efficient preparation of high-intensity, low-energy hadron beams for acceleration in a drift tube linac (DTL), thereby boosting the efficiency of transfer between a source and a DTL accelerator from 50% to more than 90%.

Typical RFQ accelerators are configured to focus, bunch and accelerate a continuous beam of charged particles with high efficiency, while preserving the emittance. The bunching of the RFQ is typically performed adiabatically over several cells so as to ensure maximum beam capture. Existing RFQ designs aim to maximise capture and thereby minimise beam losses, as beam losses are traditionally associated with risks such as the activation of the surrounding environment.

An example of an existing RFQ design is the CERN Linac4 RFQ, which is designed to reach energies as high as 3 MeV, and requires a length of 3 meters to achieve this output energy. In certain applications like injection into hadron therapy linacs for cancer treatment, much higher energies are required, such as 5 MeV or 10 MeV or even higher. However, higher energies typically require much longer, RFQs; and this can make it impractical to use the RFQs in environments such as hospitals. For example, the IPHI RFQ can reach a 5 MeV energy output, but at over 6 meters in length, this may be too large to be practical.

There is therefore a need for compact RFQ designs that are capable of producing high energy particle beams.

SUMMARY

According to one aspect of the present invention, a compact radio-frequency quadrupole 'RFQ' accelerator for accelerating charged particles is provided, the RFQ accelerator comprising: a bunching section configured to have a narrow radio-frequency 'rf' acceptance such that only a portion of a particle beam incident on the bunching section is captured, and wherein the bunching section bunches the portion of the particle beam; an accelerating section for accelerating the bunched portion of the particle beam to an output energy; and, a means for supplying radio-frequency power.

By configuring the bunching section to have a narrow rf acceptance such that only a portion incident particles are captured, it is possible to achieve substantially shorter RFQ designs. Traditional designs keep the rf acceptance large so as to capture as many of the particles in the bucket as possible, and gradually increase the synchronous phase to bunch all the particles to a low emittance. By keeping the rf acceptance narrow and accepting the resultant beam losses, the particles that are captured in the smaller bucket can be bunched and accelerated over a much shorter length.

In some example embodiments, the bunching section is further configured to rapidly increase the synchronous phase of the particle beam incident of the bunching section. By rapidly increasing the synchronous phase of the incident particle beam, the bunching section can be kept short, as fewer cells would be required to change the phase. This rapid increase may be in the form of a non-adiabatic increase.

In some example embodiments, the narrow rf acceptance is caused by the input of the bunching section having a synchronous phase of greater than −50 degrees, preferably greater than −40 degrees, and more preferably −30 degrees. Rather than having a synchronous phase of −90 degrees and slowly increasing it to the phase at the accelerator stage, the synchronous phase is started much higher at −50 degrees. This higher initial phase results in a narrower rf acceptance, but leads to a much shorter bunching section length.

In some example embodiments, the bunching section is configured to increase the synchronous phase of the particle beam incident of the bunching section to between −25 and −15 degrees.

In some example embodiments, the RFQ accelerator further comprises a radial-matching section for transforming a particle beam incident on the matching section with a time-independent focalisation to a particle beam with a time-varying focalisation.

In some example embodiments, the bunching section is less than 40 cm in length, and preferably between 20 and 30 cm in length.

In some example embodiments, the means for supplying radio-frequency power comprises a plurality of radio-frequency power sources distributed along the RFQ accelerator. Supplying rf power through a number of distributed rf power sources allows for smaller, cheaper rf sources, while still being able to achieve high power.

In some example embodiments, the means for supplying radio-frequency power supply power at a frequency of greater than 500 MHz, preferably between 700 MHz and 1 GHz. Supplying frequencies higher than 500 MHz leads to a much more compact RFQ design.

In some example embodiments, the RFQ accelerator further comprises one or more adjustable tuners for adjusting electric and magnetic field distributions, each of said adjustable tuners being adjustable by means of a screw gauge.

In some example embodiments, each said adjustable tuners have a tuner head with an at least partially conical shape, the partially conical shape having a rounded tip. Shaping the tuner head in this way leads to a high Q value and lower sensitivity than typical cylindrical tuners.

In some example embodiments, the partially conical shape has a height to radius ratio of between three-fifths and four-fifths, and preferably two thirds. This height to radius ratio can result in an optimum Q value.

In some example embodiments, the RFQ accelerator is less than 6 m in length, preferably 5 m, and the output energy is at least 7 MeV, preferably between 10 MeV and 12 MeV.

High energies at comparatively short lengths have several advantages. For example, a compact design allows the RFQ to be short enough and light enough to be placed closer to where they are needed, such as within a hospital room. Smaller designs can also lead to reduced material requirements, and can be more cost effective.

In some example embodiments, the RFQ accelerator is less than 3 m in length, preferably 2 m, and the output energy is at least 4 MeV, preferably 5 MeV.

In some example embodiments, the RFQ accelerator comprises at least two resonant cavities, each of the at least two resonant cavities being separated from adjacent resonant cavities by a drift region between vanes. By using two or more cavities separated by a drift region it is possible to achieve higher energy outputs than if using single accelerating sections, thereby reducing the sensitivity to mechanical errors. Furthermore, this modular design has additional benefits, such as cheaper costs of replacement and manufacture.

In some example embodiments, the accelerated charged particles comprise any of one of protons, deuterons and alpha particles.

According to another aspect of the present invention, method of accelerating charged particles using a compact radio-frequency quadrupole 'RFQ' accelerator, the method comprising: capturing at a bunching section only a portion of a particle beam incident on the bunching section, wherein the bunching section is configured to have a narrow rf acceptance such that only the portion of the particle beam is captured; bunching the portion of the particle beam at the bunching section; accelerating at an accelerating section the bunched portion of the particle beam to an output energy; and, supplying radio-frequency power by a means for supplying radio-frequency power.

In some example embodiments, the method further comprises producing at least one of technetium, astatine and fluoride by accelerating charged particles at target substances using the RFQ accelerator.

BRIEF DESCRIPTIONS OF DRAWINGS

Examples of the present proposed apparatus will now be described in detail with reference to the accompanying drawings, in which.

DETAILED DESCRIPTION

Figure 1:
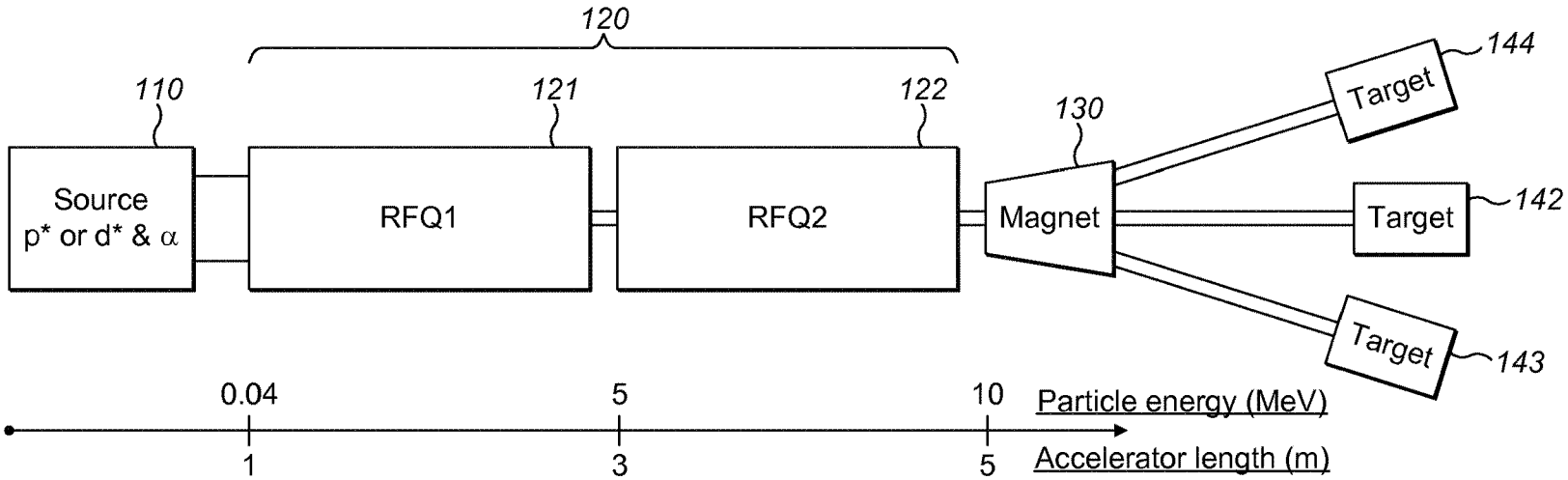
FIG. 1 is a schematic diagram of a system including the proposed RFQ design.

Reference will now be made to FIG. 1 which is a schematic diagram of a system incorporating the proposed RFQ apparatus. Specifically, the figure shows a source 110 coupled to an RFQ system 120 which outputs the accelerated source particles to one or more targets 141 to 143 via a magnet 130.

The source 110 supplies the RFQ system 120 with charged particles such as protons, deuterium and alpha particles. The type of particles supplied by the source 110 depends on the intended use of the RFQ system, and the exact parameters of the RFQ design can be adapted to accommodate the intended use. The particles provided to the RFQ 120 by the source 110 can be any charged particle which may be optionally focussed to an aperture of the RFQ 120.

The source 110 emits the charged particles into the RFQ system 120 which may contain one or more coupled RFQs 121 and 122. A single RFQ 121 may be used, but it is envisioned that additional RFQs could be added as required. Providing this modular approach has both manufacturing and cost benefits over manufacturing single, long RFQs for higher energy accelerators. In the example provided, each RFQ is roughly 2 m long and can accelerate particles by about 5 MeV, therefore coupling two of these RFQs together can result in output energies of 10 MeV over 5 m.

The RFQ system 120 accelerates the beam to an output energy. The output beam could then be accelerated further by additional accelerators (such as a DTL), or it could be sent straight on to the target 141. Multiple targets could be used, in which case a form of beam deflection or redirection, such as a magnet 130 could be used. As the RFQ is capable of pulsed operation, redirecting the beam to individual targets is possible by triggering the redirection in-between pulses, for example.

Figure 2:
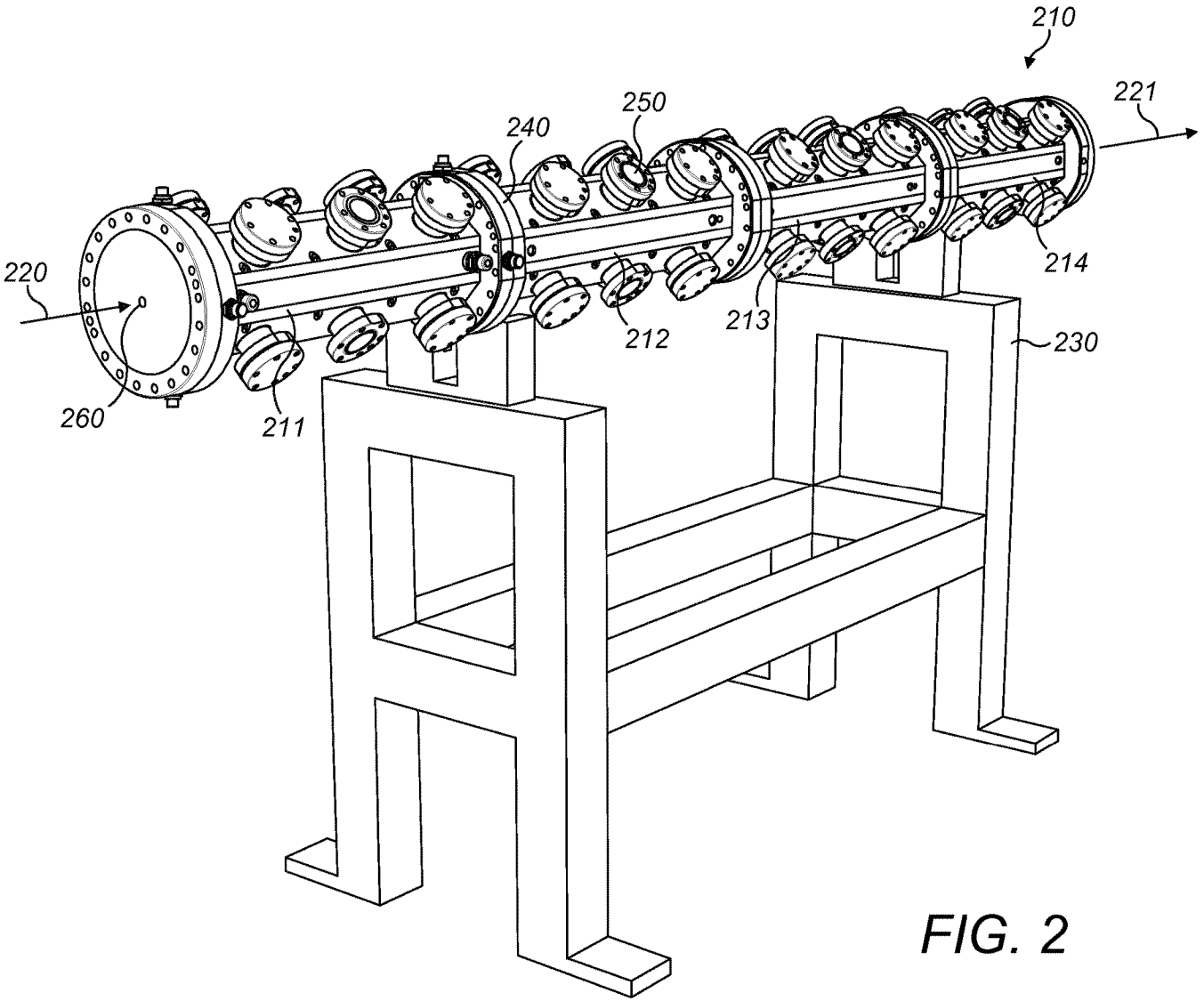
FIG. 2 shows a perspective view of the proposed RFQ apparatus.

FIG. 2 shows a perspective view of the proposed RFQ apparatus 210 mounted on a support 230. The single RFQ apparatus 210 may comprise several 'modules' 211, 212, 213 and 214 that have been connected together along a linear path without substantial gaps between them. An input beam 220 enters the opening aperture 260 of the first module 211 before being output as an accelerated beam 211 out of the final module 214. The accelerated beam 211 may be sent on to a further RFQ apparatus, a target or a further accelerator of a different type.

Flanges 240 may be found at each end of each module, and can be used to connect adjacent modules together and to provide support when resting the RFQ apparatus on a supporting apparatus 230. The supporting apparatus 230 may be made from aluminium profiles, and keeps the RFQ at the necessary elevation for the beam to line up with the appropriate sources and targets.

Ports 250 may be located along each of the modules, and provide external access to the internals of the RFQ. This could be useful for attaching tuners to adjust the fields within the RFQ cavities.

Figure 3:
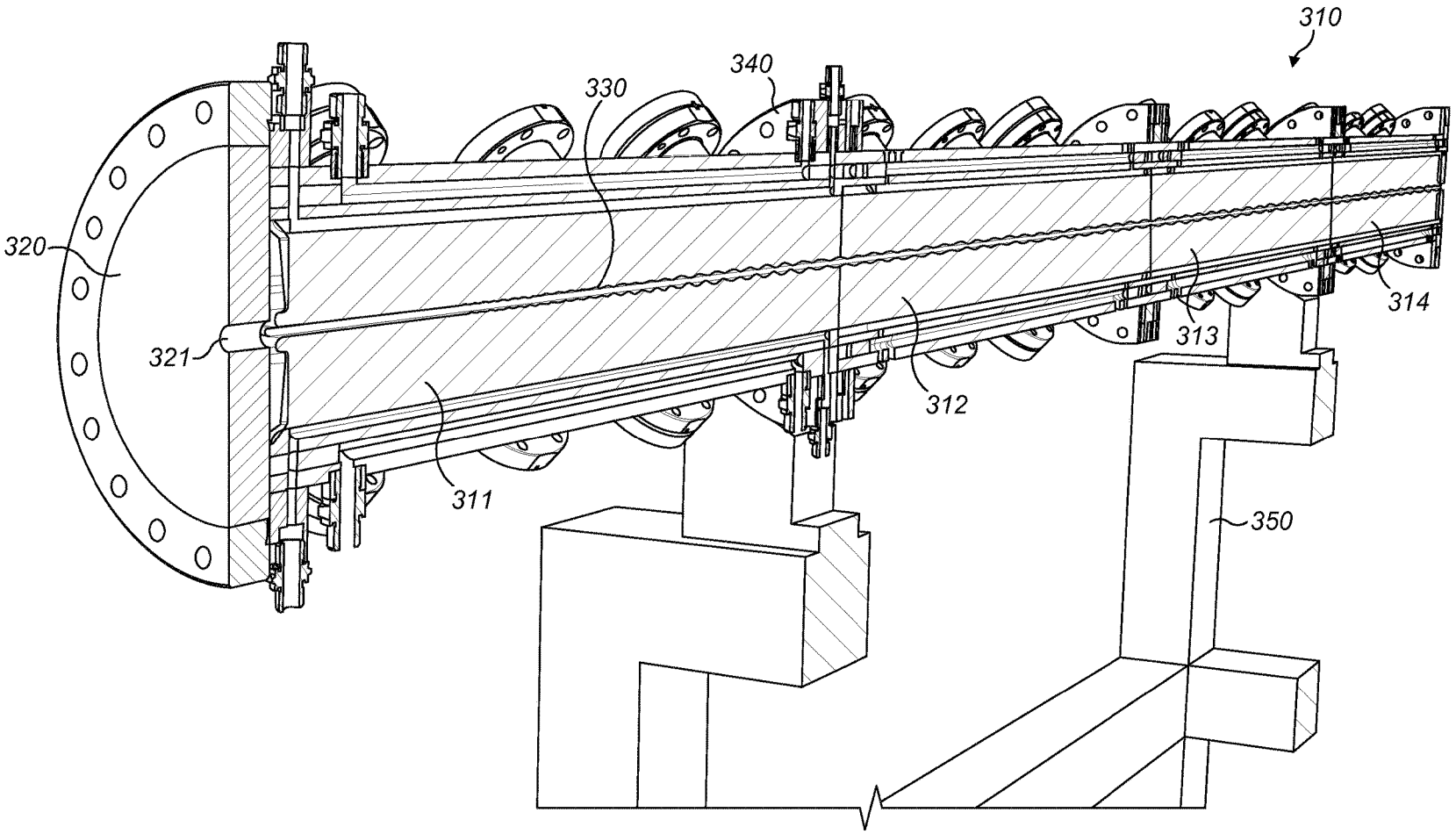
FIG. 3 shows a cross-sectional view of the proposed RFQ apparatus.

FIG. 3 shows a cross-sectional view 310 of the RFQ apparatus shown in FIG. 2. The cross section is taken along a vertical plane along the length and through the centre of the RFQ, and shows the central beam path 330. The modules 311, 312, 313 and 314 can be seen to be firmly connected to their adjacent module, without a substantial gap between them to ensure that modulations along the vanes are uninterrupted.

The flange 320 at the front of the first module 311 is mostly covered with an opening 321 to allow particles to enter into the beam path 330. The flange at the end of the final module 314 would have a similar design to the front flange 320. Intermediate flanges 340 between inner modules surround the core of the modules and can be seen to rest on top of the support structure 350.

Figure 4:
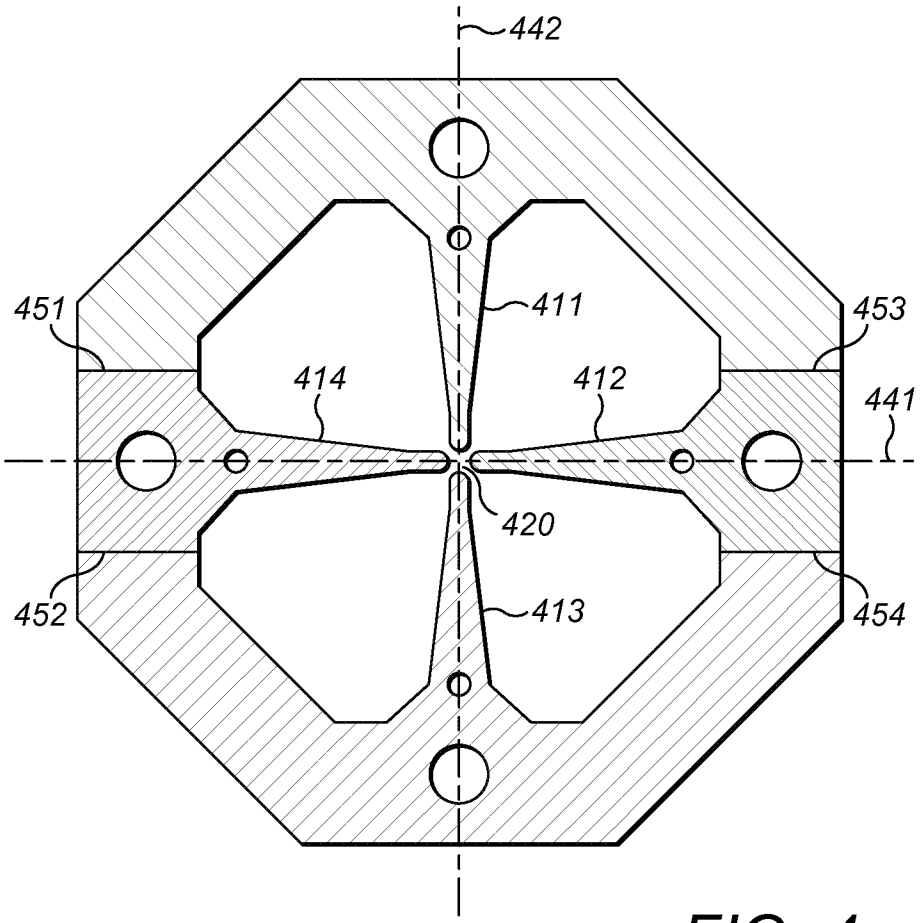
FIG. 4 shows a cross-sectional view of the vane structure of the proposed RFQ apparatus.
Figure 4:
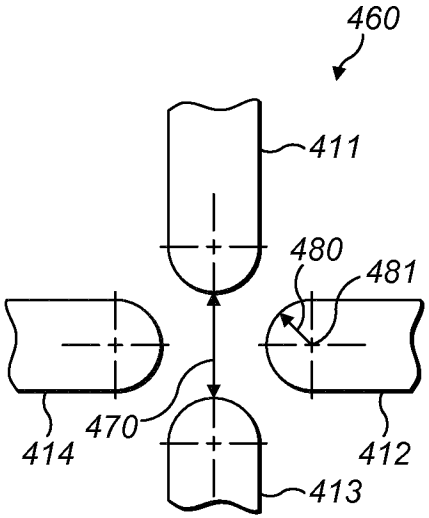

FIG. 4 shows a cross-sectional view of the RFQ apparatus shown in FIG. 2. The cross section is taken along a vertical plane cutting across the central beam axis to show a slice of the four-vane structure which continues through the length of the RFQ. The view shows how four vanes 411, 412, 413 and 414 extend into the centre of the RFQ to surround the central aperture 420 though which particles travel. The empty region inside the RFQ defines the resonant cavity 430, which will typically be maintained at a vacuum.

The vane structure may be substantially symmetric across both the horizontal 441 and vertical 442 axes (four-fold symmetry). The vanes are preferably constructed from a highly conductive metal such as copper. It is preferable to design the vanes to be slim so as to minimise the power consumption, while still being thick enough to ensure adequate cooling efficiency.

The vanes extending along the length of the RFQ may be formed from a singular piece of metal, although it would be preferably from a manufacturing point of view to construct the vane structure from separate elements joined together. For example, in the structure shown in FIG. 4, four separate components are mounted together, contacting at joints 451, 452, 453 and 454. In the example provided, the upper 411 and lower 413 vanes may be manufactured by the same process, while the side vanes 412 and 414 may also be the same as one another, thereby requiring only two different manufacturing processes for these four vanes.

Inset 460 shows a more detailed view of the tips of vanes 411, 412, 413 and 414 and the region around the aperture 420. The vane tips are preferably curved, and the distance Rho 480 defines the radius of curvature of the vane tips about a centre of curvature 481 of each vane tip. As will be discussed later, the distances between opposing vanes will modulate along the length of the RFQ, but distance 2Ro 470 defines the average length between opposing vanes.

The vane structure shown in FIG. 4 shows a cross-sectional slice of one possible vane structure suitable for the proposed RFQ. However, the vane structure may change along the length of the RFQ, not only through the modulations of the vane tips, but also in the size and shape of the resonant cavity 430.

Beam Dynamics

One of the benefits of the proposed RFQ apparatus is that it allows the formation of high energy beams with a much shorter length than existing solutions. One contributing factor to the compact size of the proposed RFQ is the novel beam dynamic design.

Figure 5:
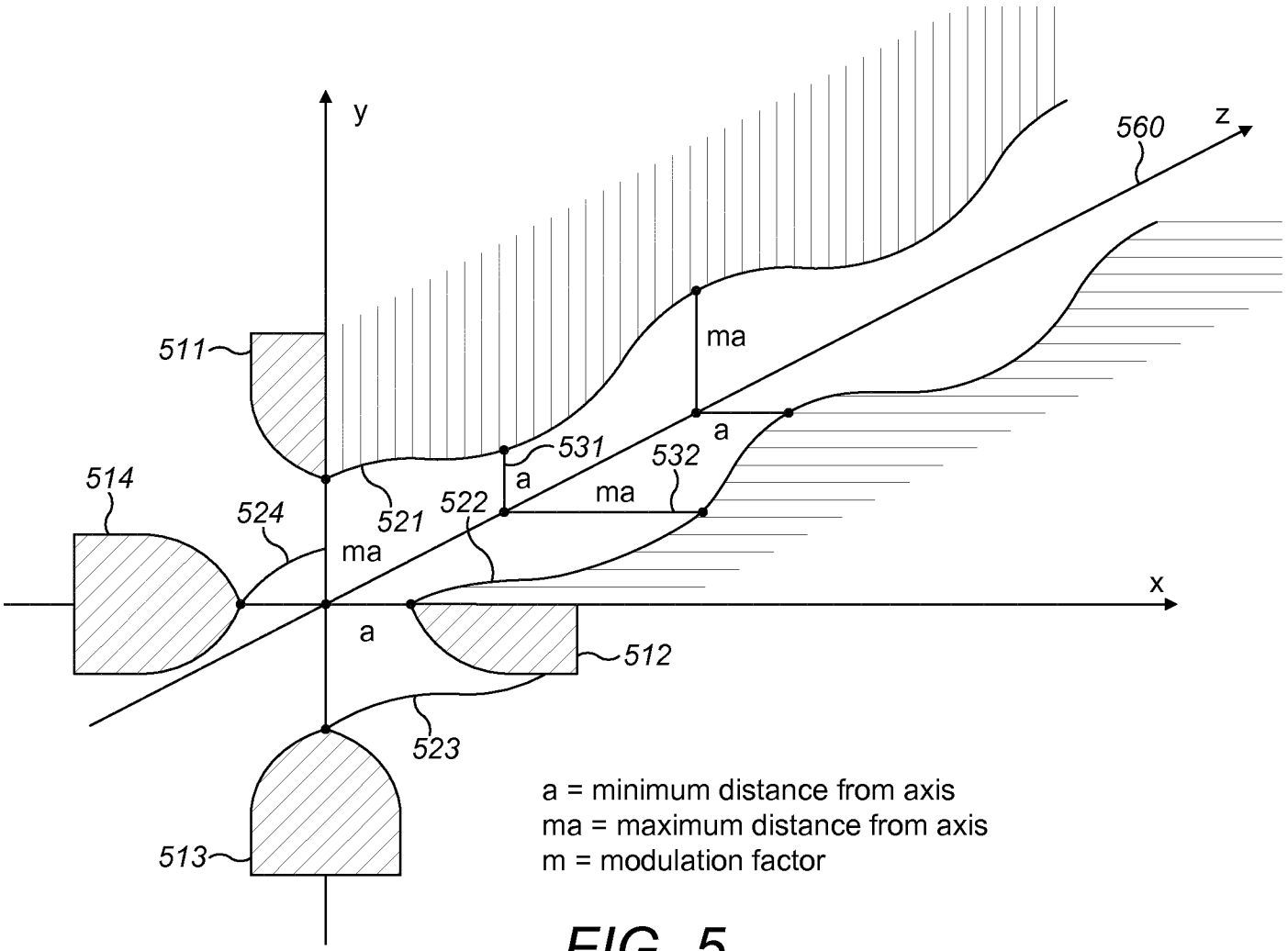
FIG. 5 illustrates the longitudinal modulation of the vane structure in an RFQ.

FIG. 5 is an illustration of the longitudinal modulation of the vane structure in a typical RFQ. Vane tips 511, 512, 513 and 514 correspond to the vanes 411, 412, 413 and 414 in FIG. 4, but FIG. 5 also illustrates the modulation of the vane tips 521, 522, 523 and 524 along the beam axis 560 of the RFQ.

The minimum distance between a vane tip and the beam axis 560 is defined by aperture value 'a' 531, while the maximum distance from the axis along the modulations is defined by 'ma' 532, where 'm' is the modulation factor. Typically, the value 'a' 531 determines the focusing strength and acceptance of the RFQ, while the size of the modulations 'm' determines the field available for acceleration.

Opposing vane tips will typically mirror each other's modulations. In other words, when the upper vane tip 521 is at the minimum distance 'a' from the beam axis so is the lower vane tip 523, while when one side vane tip 524 is at its closest distance 'a' so is the opposite vane tip 522. Furthermore, the modulations of adjacent vane tips are out of phase with one another, in other words, when upper vane tip 521 as at its closest distance 'a' to the beam axis, adjacent vane tips 524 and 522 will be at their furthest distance 'ma'. Similarly, the voltage provided to adjacent vane tips will be out of phase with one another.

A unit cell of an RFQ is defined as the region between a peak and a trough along a vane modulation (or half the distance between peaks). When a high-frequency current of wavelength $\lambda$ is applied to the vanes, if the unit cells are of length $\beta\lambda/2$ then a particle travelling through the unit cells should arrive at the start of each unit cell at the same point (phase) of the radio-frequency waveform. In other words, when the unit cells are of length $\beta\lambda/2$, a reference synchronous particle (typically the centre of a bunch of particles) will experience the same phase (the synchronous phase $\varphi_s$) of the rf wave on entering each subsequent unit cell. Note that $\beta$ is the speed of the particle at that point in its trajectory as a fraction of the speed of light, c, therefore $\beta c$ is the speed of the particle in meters per second.

The phase of the rf wave that the synchronous particle experiences at each unit cell defines how the particle behaves. For example, when the phase of the synchronous particle $\varphi_s$ is 0°, then the particle will experience a smooth acceleration along the RFQ. However, this smooth acceleration would only apply to particles at the position of the reference synchronous particle, and any particles arriving slightly after or slightly before the synchronous particle would become unstable and their trajectory along the RFQ and may be lost.

Conventional RFQ designs, therefore, dedicate a significant proportion of the overall design of the RFQ to preventing such losses, by ensuring that as many particles are 'bunched' near to the synchronous particle before large accelerations to ensure that all the particles in the bunch can be accelerated without loss.

Figure 6:
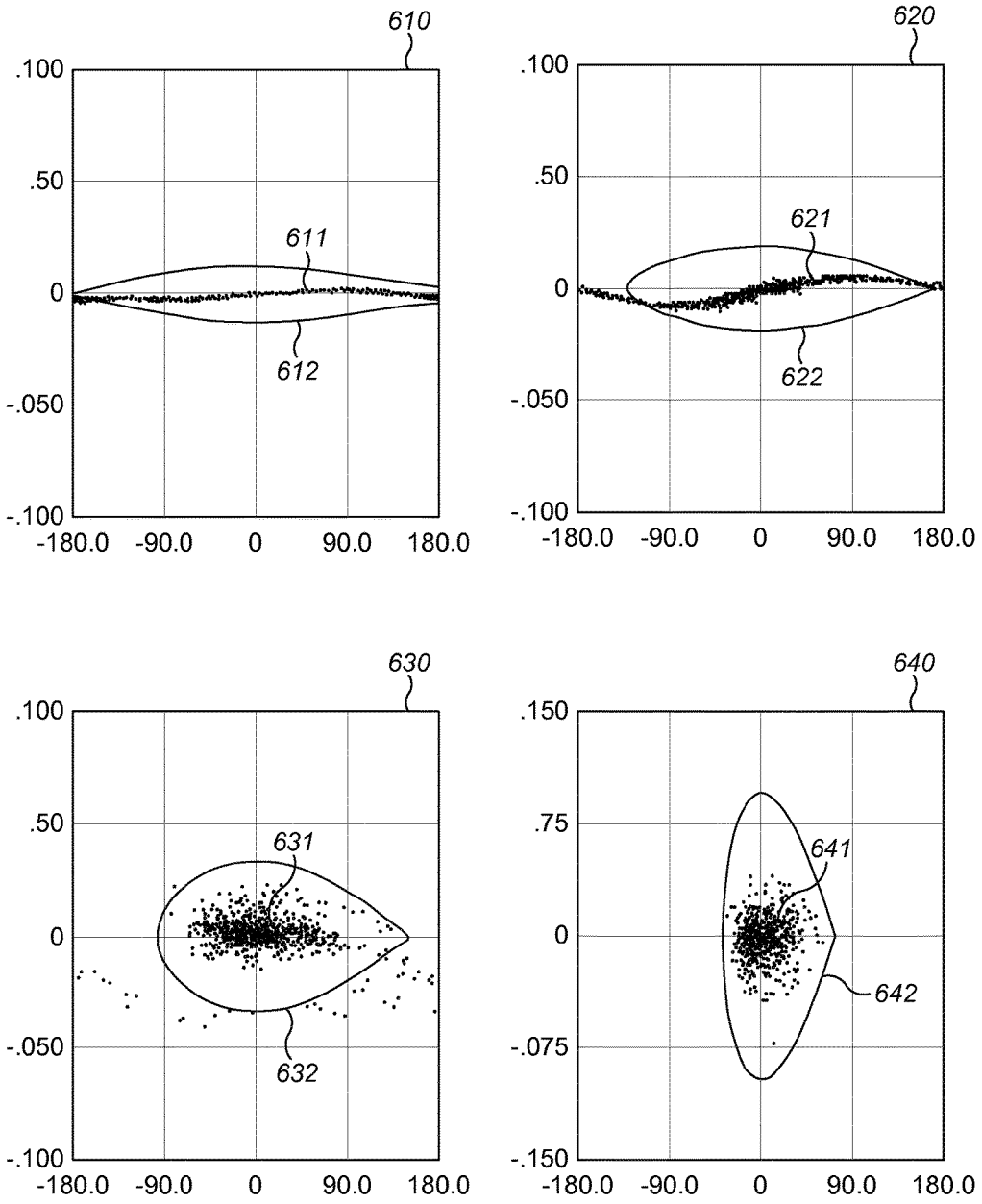
FIG. 6 is a series of phase-space diagrams illustrating the changes of a beam during a bunching phase of a conventional RFQ.

FIG. 6 shows a series of phase-space diagrams 610, 620, 630 and 640 illustrating the changes of a beam during the bunching process in a conventional RFQ. Where the x-axis of the phase-space diagrams shows the phase of particles in a bunch relative to a reference synchronous particle at the centre, the y-axis indicates the energy of the particles.

The phase-space diagram 610 shows the beam characteristics of a uniform beam entering the RFQ, where the synchronous phase $\varphi_s$ is near the 'stable' phase of −90°. At this point in the beam profile, most particles 611 are spread out evenly across all phases (indicated by the horizontal spread) and with little variation in the energy (indicated by the lack of vertical spread). The separatrix 612 surrounding the particles 611, indicates the boundary between stable and unstable particles. At this phase, the synchronous particle will experience no or little acceleration, while particles ahead will experience deceleration towards the central synchronous particle, and particles behind will experience acceleration towards the central synchronous particle.

In conventional RFQs, the parameters of the early cells in an RFQ will be chosen so that the separatrix 612 entirely surrounds all the input particles 611 to ensure that none of the particles lie outside the stable region and are lost. Over the cells, as the beam particles start to bunch up closer to the synchronous particle and the energy spread increases, typical RFQs will increase the synchronous phase along the cells to ensure that the separatrix still includes as many of the beam particles as possible through a process known as adiabatic bunching. This change in synchronous phase can be achieved by changing the size of the unit cells by the formula $$\frac{\beta\lambda}{2}\left(1-\frac{\Delta\varphi}{2\pi}\right),$$

wherein $\Delta\varphi$ is the required change in synchronous phase between adjacent cells.

Phase-space diagram 620 shows the beam characteristics further down the example conventional RFQ, where the particles 621 have started to increase in the spread in energy and the separatrix 622 has changed in shape to accommodate the increase in energy spread, albeit with some losses from particles with lower phases that lie outside the separatrix 622. Phase-space diagram 630 shows the beam characteristics of the example conventional RFQ further along the RFQ where the synchronous phase has been increased further to ensure that the separatrix 632 includes the ever widening energy spread of the particles 631.

Phase space diagram 640 shows the beam characteristics of the $300^{th}$ cell of a the example conventional RFQ where most of the particles 641 are bunched near the synchronous particle and the separatrix 642 includes this spread of particles 641. With the particles 641 suitably bunched near the reference synchronous particle, the bunch of particles can now sustain consistent acceleration by maintaining a low synchronous phase along the remaining length of the RFQ.

While the example illustration of a conventional RFQ design in FIG. 6 does not represent perfect adiabatic bunching, as some particles are lost, most existing RFQ designs aim towards adiabatic bunching to ensure beam losses stay below 10%, and preferably lower. Indeed, the concept of slow, but stable adiabatic bunching is so pervasive in conventional RFQ design, that almost every RFQ created incorporates this bunching phase that attempts to capture as many input particles as possible, and bunch these particles into a distribution suitable for high acceleration.

In the field of accelerator design, particularly RFQ design, there is significant prejudice towards beam losses, and RFQs are typically designed to ensure that over 90% of the input beam particles are 'captured'. The reason behind this conventional teaching is that particles that are not captured can pose significant risks as they will be accelerated in an unstable way along the accelerator. These high-energy, unstable particles may deviate from their intended path and cause damage (activation) to the apparatus or surrounding environment. Furthermore, low beam loss is often a high priority of RFQ design so that source particles are not wasted, and a high beam current can be achieved.

The beam dynamics of the proposed RFQ design deviates substantially from conventional wisdom to arrive at an RFQ significantly shorter than a conventional RFQ design.

Figure 7:
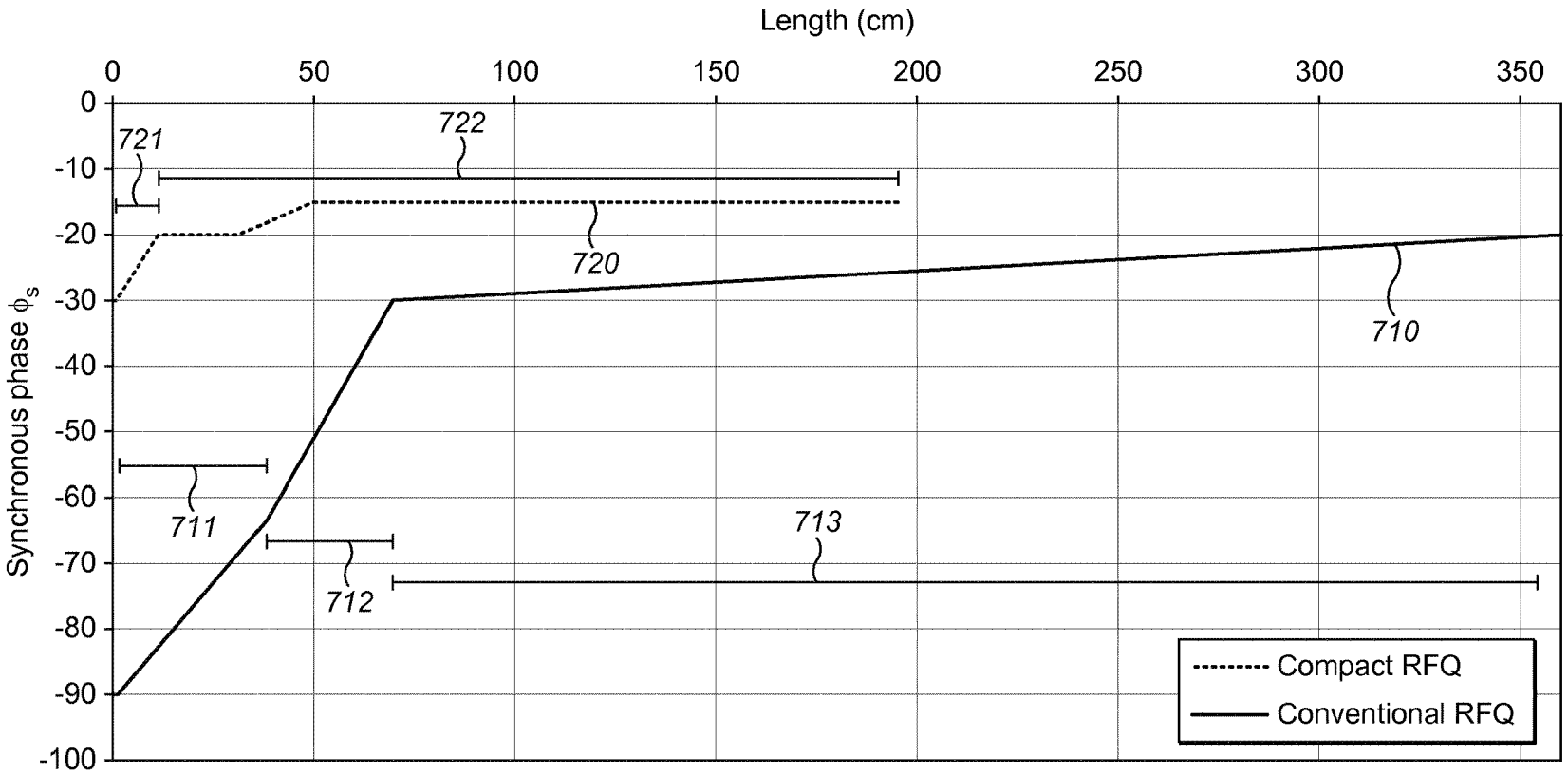
FIG. 7 is a graph illustrating how synchronous phase of the proposed RFQ apparatus differs from a conventional RFQ.

FIG. 7 is a graph showing how the synchronous phase of the proposed RFQ and a conventional RFQ varies with the length along the RFQ, and further shows how the beam characteristics of the proposed RFQ differs.

Line 710 shows how the synchronous phase of an example RFQ changes along the length of the RFQ using a conventional beam design. The RFQ represented by line 710 is designed to accelerate particles from 0.04 to 5 MeV over a length of 3.5 m. This already represents a relatively short RFQ design for the given energy gain as a high frequency of 750 MHz is being used. Typically, the higher the frequency used, the lower the rf wavelength, and therefore the smaller the unit cells. Although higher frequencies can result in shorter RFQ lengths, accurately manufacturing the initial short cells can be difficult, therefore 750 MHz is chosen to provide an adequate balance between shortness of RFQ and ease of manufacture. Nevertheless, both lower and higher frequencies are envisioned, as more accurate manufacturing techniques could be used for higher frequencies, while cheaper techniques could be used for lower frequencies.

Conventional beam designs can typically be separated into four sections. The first, relatively short section is the radial matching section (not shown) where a large input aperture is decreased down to a smaller aperture in a trump-like shape without modulations (m=1) and with the focusing strength increasing from 0 up to the value for the rest of the RFQ. The radial matching section typically only extends over a few cells and adiabatically matches a dc input beam to a strong transverse focusing structure.

The next section of a conventional beam design is the shaping section indicated by region 711. The shaping section typically starts at a synchronous phase of −90° to capture all the particles in the continuous beam and slowly increasing the synchronous phase to focus the beam, get the bunching section started and impart some acceleration on the beam. As could be seen in phase-space diagram 620 in FIG. 6, these sections often incur some losses as the process is not completely adiabatic, but these losses are typically minimal in quantity. After about 40 cm or 190 cells, the shaping section 711 would have increased the synchronous phase to −60°.

The next section of a conventional beam design is the (gentle) bunching section that typically adiabatically bunches the beam and accelerates it to an intermediate energy. In this example, the bunching section extends over 30 cm or 70 cells and increases the synchronous phase from −60° to −30°.

Once the particles are suitably bunched and the synchronous phase has been increased to one suitable for high accelerations, the final accelerating section 713 begins. Over this accelerating section 713, the synchronous phase is kept constant or increased very slowly from −30° to −20° over 2.9 m or 210 cells.

As can be seen from FIG. 7, the RFQ using a conventional beam design dedicates the first 70 cm of the RFQ length to shaping and bunching the beam to ensure as many of the incoming particles are captured and brought together to a position where the acceleration can begin.

Line 720 shows the variation of synchronous phase of the proposed RFQ design, and represents a significant shift from traditional beam designs. In the proposed RFQ design the equivalent of the shaping and bunching section is contained within the first 10 cm or 52 cells 721. Compared to the 70 cm or 260 cells of the conventional beam design 710 this is substantially shorter.

Rather than starting the RFQ at the 'stable' synchronous phase of −90° to capture all input particles, the synchronous phase is started much higher at −30°. While the separatrix at −90° synchronous phase would cover most particles at an input beam, the separatrix at a −30° starting synchronous phase would cover a significantly narrower range of phases of the incoming particles. Therefore, only about 30% to 40% of particles would be within the 'stable' region of the separatrix in the proposed RFQ design.

However, those 30 to 40% of particles that are within the stable region of the separatrix can be bunched rapidly over very few cells, so that when the accelerating section 722 starts those bunched particles are ready for acceleration over the next 1.9 m to a final energy of 5 MeV.

The result of the proposed RFQ beam design is that particles can be accelerated from 0.04 MeV up to 5 MeV in only 2 m. Ignoring the beam losses for now, which will be discussed later, the proposed RFQ design presents a significant improvement over any existing RFQ design in terms of energy gain per meter length.

Figure 8:
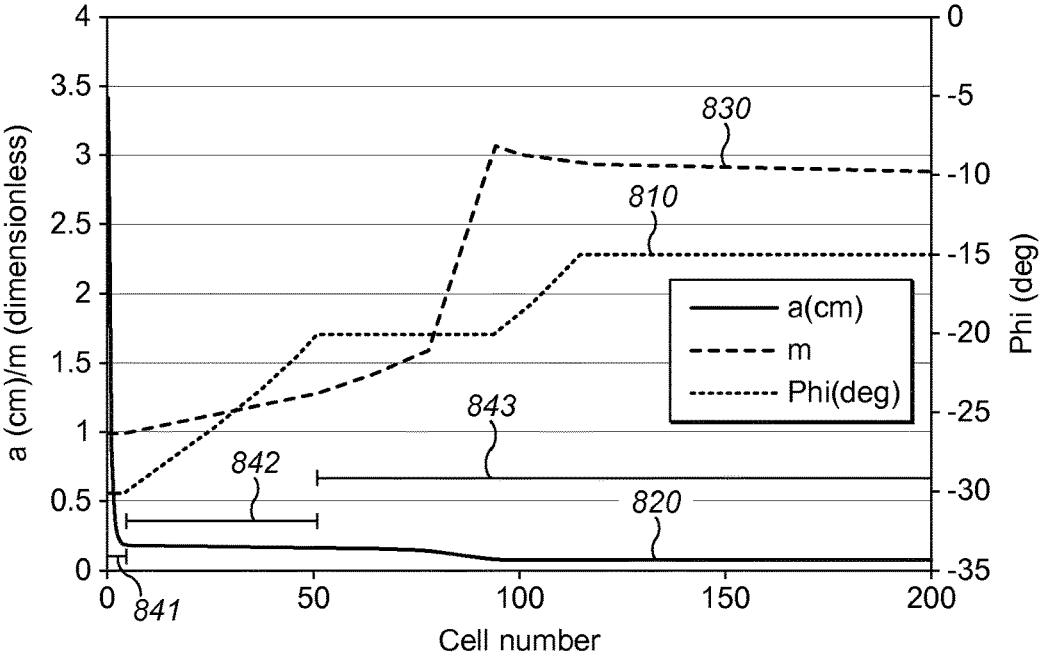
FIG. 8 is a graph showing the variation in aperture, modulation and synchronous phase with cell number in the proposed RFQ apparatus.

FIG. 8 is a graph showing the variations in parameters of the proposed RFQ at each cell along the RFQ. The parameters 'a' 820, 'm' 830 and synchronous phase $\varphi_s$ 810 for the proposed RFQ design are plotted against cell number. Cell number is used on the x-axis rather than length as it better illustrates the changes in parameter values in the earlier regions of the RFQ.

The radial matching section 841 can be seen by the rapid decrease in aperture value with constant modulation factor. The rapid bunching section 842 shows the increase in synchronous phase from −30° to −20° and a gradual increase of modulation factor. At the start of the accelerating section 843, the synchronous phase is kept constant at −20° while the modulation factor is increased faster. Between cell numbers 78 to 94 the modulation factor quickly doubles, while the synchronous phase remains constant and the aperture decreases. From cells 95 to 115 the synchronous phase begins a further increase from −20° to a phase of −15° where it remains, while the aperture stays relatively constant and the modulation factor decreases slightly.

While the difference in the trend of synchronous phase represents a significant departure from conventional beam design, the accompany modulation factor and aperture profiles along the length of the RFQ also contribute to this novel beam design.

Figure 9:
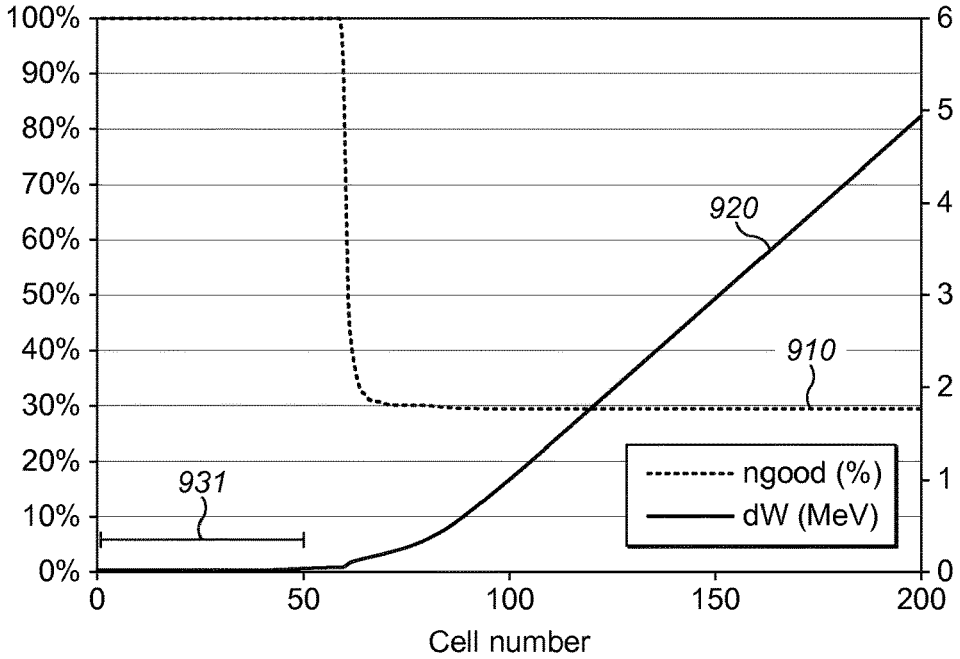
FIG. 9 is a graph showing the change in beam energy and particle loss along the cells of the proposed RFQ apparatus.

FIG. 9 illustrates some of the significant effects of proposed RFQ beam design, showing the change in beam energy 920 and particle loss 910 along the cells of the proposed RFQ apparatus.

The beam energy line 920 shows that the energy increases to 5 MeV over 200 cells, while the particle loss line 910 shows that of the 100% of input particles at the first cell, only 30% of particles are found in the output beam. Under conventional wisdom, such high beam losses would be seen as highly undesirable. However, in the proposed beam design, these beam losses have been carefully and intentionally controlled to ensure that they do not present the same disadvantages that are typically associated with beam losses.

During the rapid bunching phase 931, the beam losses are kept to a minimal. While many of the particles in the input beam will lie outside of the narrow stable region of the separatrix at −30° synchronous phase, these particles are not immediately lost. While the particles within the separatrix are bunched over the next fifty cells, the particles outside the separatrix remain within the advancing beam, albeit in an unstable state. It is only once the accelerating section begins that the stable and unstable particles become separated, as stable particles bunched within the separatrix advance in a controlled acceleration while those outside the separatrix are rapidly lost. Indeed, over the space of a few cells, 70% of the particles in the beam are lost in this illustrative example.

Under conventional wisdom, beam losses of this magnitude are highly undesirable, not least for the safety implications. Typically, when beam losses are incurred due to imperfect adiabatic bunching, by the time particles reach the accelerating phase, those particles that are not adequately bunched will be lost at the accelerating stage, resulting in high energy particles escaping into the surrounding environment.

Looking back to FIG. 7, if there were particles outside the separatrix at the beginning of the accelerator section 713, these particles would have already been accelerated to high energies during the shaping and bunching phases over the initial 70 cm, so if they are lost at the accelerating phase, these high energy particles would escape into the surroundings. In contrast, in FIG. 9, it can be seen that although a significant proportion of particles are lost between cells 60 and 70, the energies of these particles are exceptionally low, mostly between 0.07 and 0.1 MeV.

Figure 10:
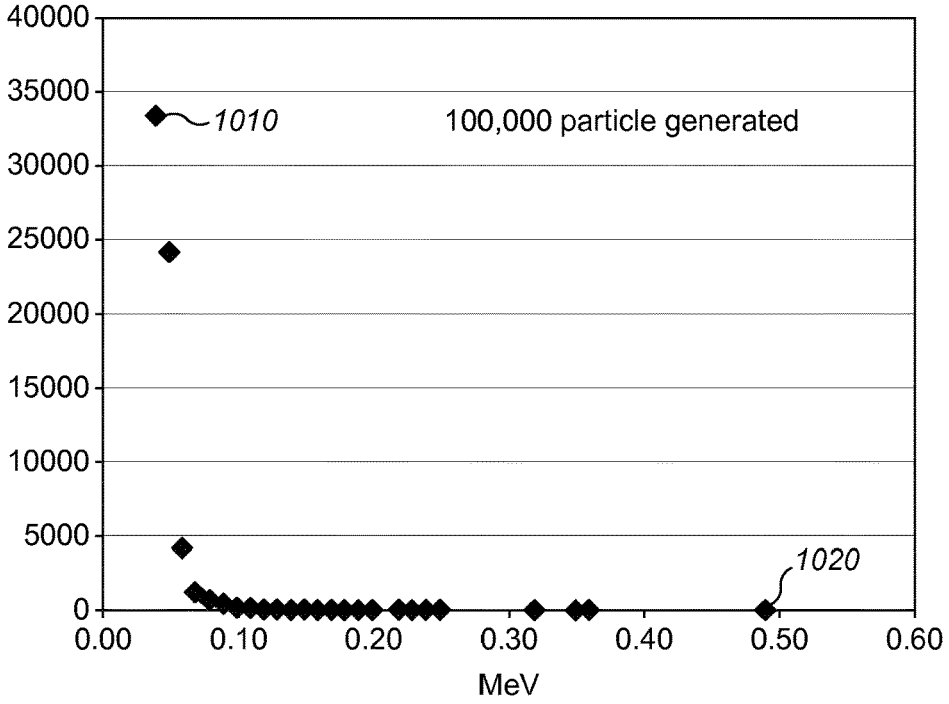
FIG. 10 is a graph showing the distribution of energies of lost particles in the proposed RFQ apparatus.

FIG. 10 shows these distribution of these beam losses in greater detail. Out of 100,000 particles generated, FIG. 10 shows the energy distribution of particles lost. It is clear that most of the particles lost are very low energy 1010, while a negligible number reach as high as 0.5 MeV 1020.

This illustrates the significantly different approach in the proposed RFQ beam design. It is accepted from the start that there will be high beam losses, but the RFQ parameters are chosen such that those particles that will be lost are all lost at a very early stage while their energies are still low. As can be seen from FIG. 9, once the acceleration starts and the particles start gaining significant energies, there are no further beam losses, as those particles that have been captured are accelerated very efficiently.

The typical beam design approach is to create a separatrix or 'bucket' around all of the input particles, and gently guide all the particles in this bucket into a shape ready for the accelerating section without large losses. Providing a bucket that captures all initial particles results in a very long bunching section as all the particles at the extremities of the phase-space diagram (i.e. furthest from the synchronous particle) requires a long time to gently be eased into a phase suitable for the accelerator phase without loss.

Instead of forming a bucket around the beam, the proposed approach rapidly captures what falls within a predefined narrow bucket and allows the rest to be lost early on in the RFQ before the particles have gained too much energy to pose a threat.

The conventional wisdom has traditionally punished imperfect adiabatic bunching, as if particles lie slightly outside the bucket by the time the accelerator section begins, those high energy particles will cause damage once improperly accelerated and lost. Therefore, the conventional wisdom has been to design RFQs with as close to perfect adiabatic bunching as possible, where any deviations lead to high energy beam losses. The proposed solution makes a complete departure from traditional teaching by ignoring adiabatic bunching entirely and realising that it can be ignored as long as those particles that are lost are lost early, and those particles that are captured are securely kept within the accelerating bucket.

While example parameters for a proposed RFQ have been shown in FIG. 8, it should be clear that a whole variety of different parameter configurations are envisioned without departing from the overall inventive concept. For example, the starting synchronous phase does not have to be −30°, but could be higher or lower, and the exact profiles of the parameters can be varied depending on intended applications and accepted beam losses. Furthermore, while the example frequency of 750 MHz is preferable, the proposed solution is equally applicable to a whole range of frequencies, particularly higher ones.

Distributed RF Feeding

While the novel beam design represents a contributing factor to the compact nature of the proposed RFQ, another feature is the high frequency used. High frequency power sources, however, can be very expensive; therefore, many existing RFQ designs have avoided higher frequencies at the expense of compactness. The proposed RFQ apparatus may use distributed RF feeding to allow for a cost effective approach to attaining high frequencies.

Figure 11:
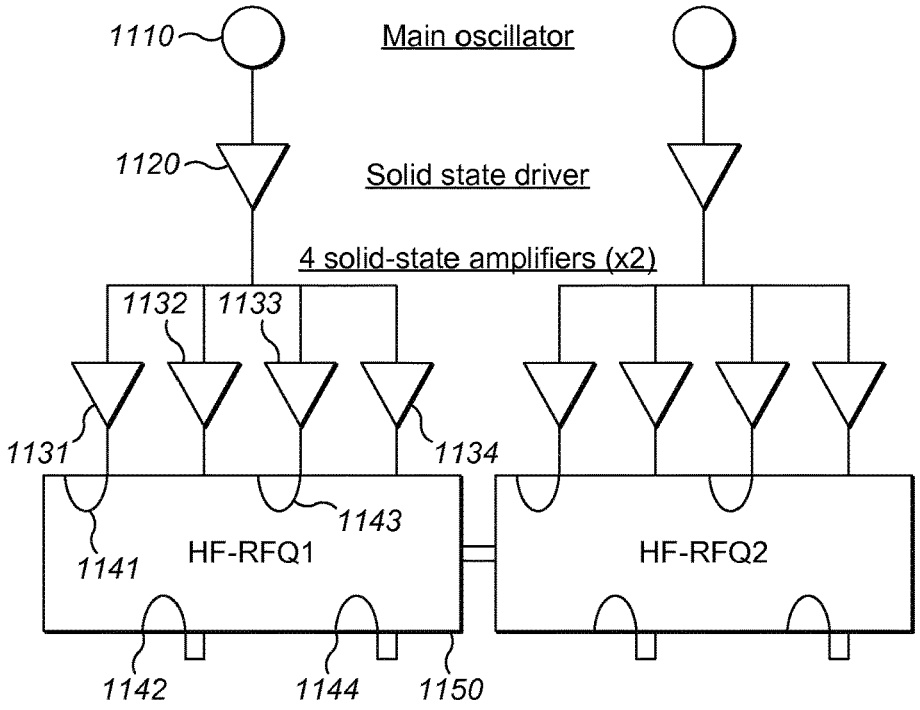
FIG. 11 is a schematic diagram illustrating the distributed RF feeding in the proposed RFQ apparatus.

FIG. 11 is a schematic diagram illustrating the use of distributed RF feeding in the proposed RFQ apparatus. Rather than using individual, expensive RF sources to power the whole RFQ, the proposed solution uses smaller, cheaper RF sources. A single, small, main oscillator 1110 may be used to generate the high-frequency required for the RFQ 1140. The output of the oscillator 1110 may connect to a solid state driver 1120 which in turn sends the signal on to be amplified by several solid-state amplifiers 1131, 1132, 1133 and 1134. These several solid-state amplifiers 1131, 1132, 1133 and 1134 may be distributed along the entire length of an RFQ 1150 at connection points 1141, 1142, 1143 and 1144. In the example provided in FIG. 11, four solid state amplifiers are provided per RFQ, however, different quantities could be used.

Using the proposed distributed RF feeding configuration, small, low-power RF sources can be used and amplified by several cheap amplifiers distributed along the RFQ.

The distributed RF feeding configuration could be an IOT-based (inductive output tube) system with roughly sixteen racks. Alternatively a klystron-based system could be used with two klystrons and modulators. Several implementations of the proposed distributed RF feeding solution are envisioned that are not limited to the examples provided.

Tuners

Tuners can be used to adjust the resonant frequencies of resonant cavities within an RFQ by inserting objects into regions of the cavity with high magnetic fields. While tuners are desirable for adjusting RFQ to the required frequency, they can be detrimental in reducing the Q-factor of the resonant cavity, and if they are too sensitive. Therefore, it is desirable to design an adjustable tuner with low sensitivity and that can provide a high Q-factor.

Figure 12:
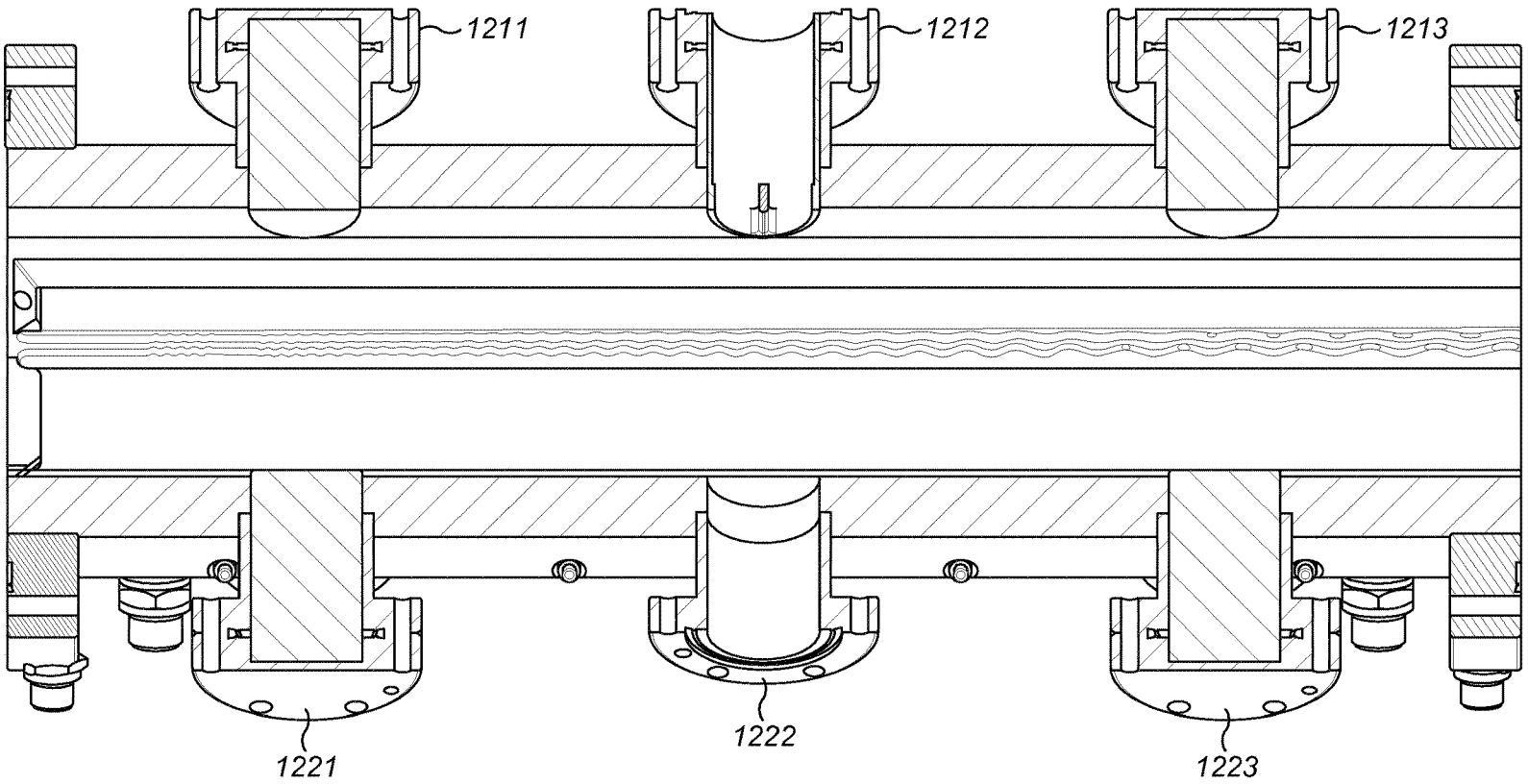
FIG. 12 is a cross-sectional view of an RFQ module illustrating the positions of tuning ports.

FIG. 12 is a cross-sectional view of an RFQ module illustrating the positioning of tuning ports along an RFQ module. There may be, for example, three ports per quadrant, with ports 1211, 1212 and 1213 being the ports of the top quadrant, ports 1221, 1222 and 1223 of the bottom quadrant, and the ports on the other two quadrants not being displayed. Some ports may be left empty, while others contain adjustable tuners. In some configurations, eight ports may be used for tuners, while four are used for either vacuum pumping or RF power couplers. Both the vacuum pumps and RF power couplers can be used for coarse tuning if required.

Figure 13:
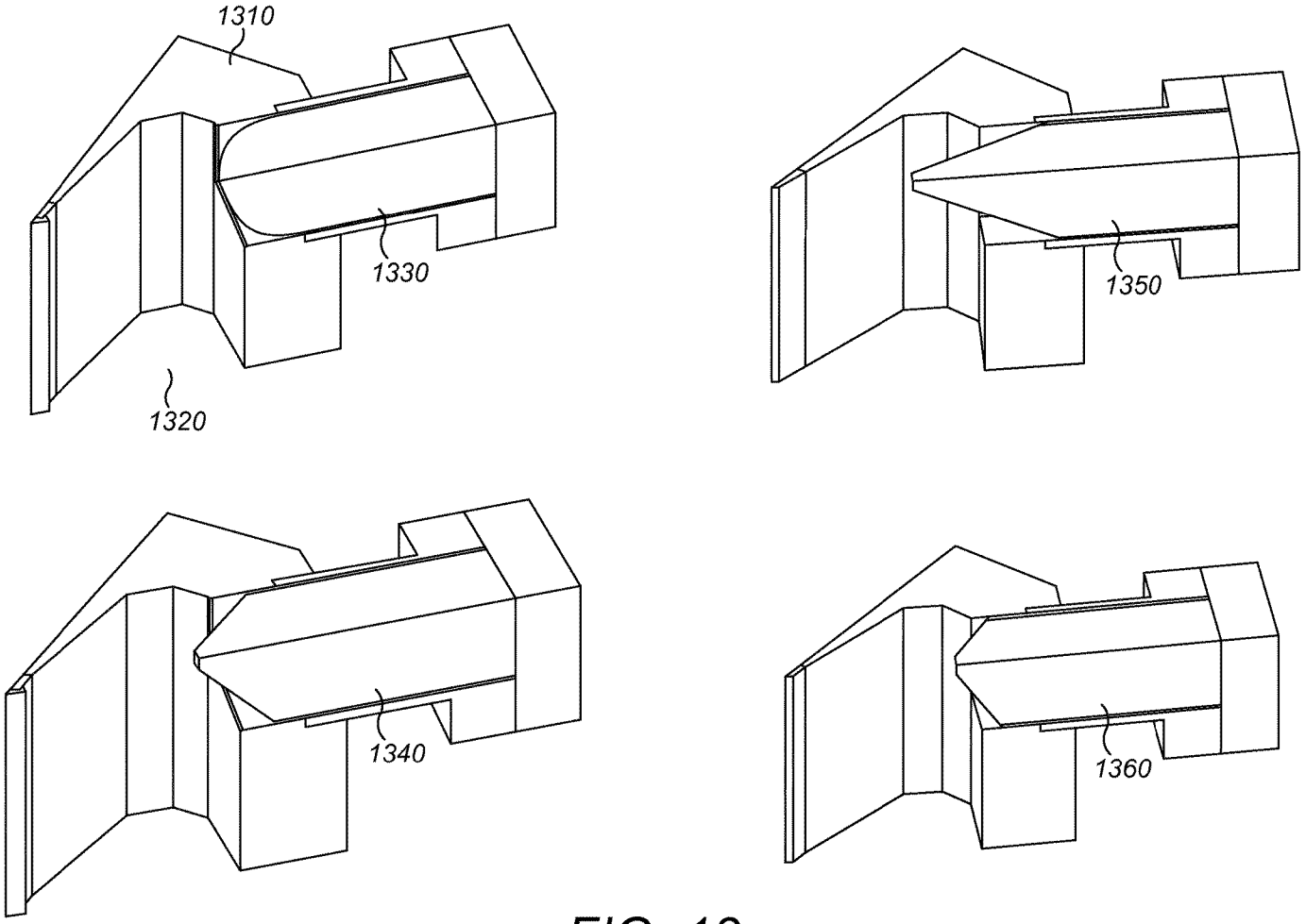
FIG. 13 is a series of diagrams showing different tuner shapes.

FIG. 13 illustrates different possible shapes for the tuner of the proposed RFQ apparatus. Each shape is shown in the context of a single quadrant of the RFQ. For example, 1310 shows a single vane in an RFQ, while 1320 represents the resonant cavity of that quadrant. Several different shapes of tuner heads were modelled, for example a round tuner head 1330, a conical tuner head 1340, and different types of conical heads, such as con2 1350 and con ⅔ 1360 which are defined by their conical dimensions.

Figure 14:
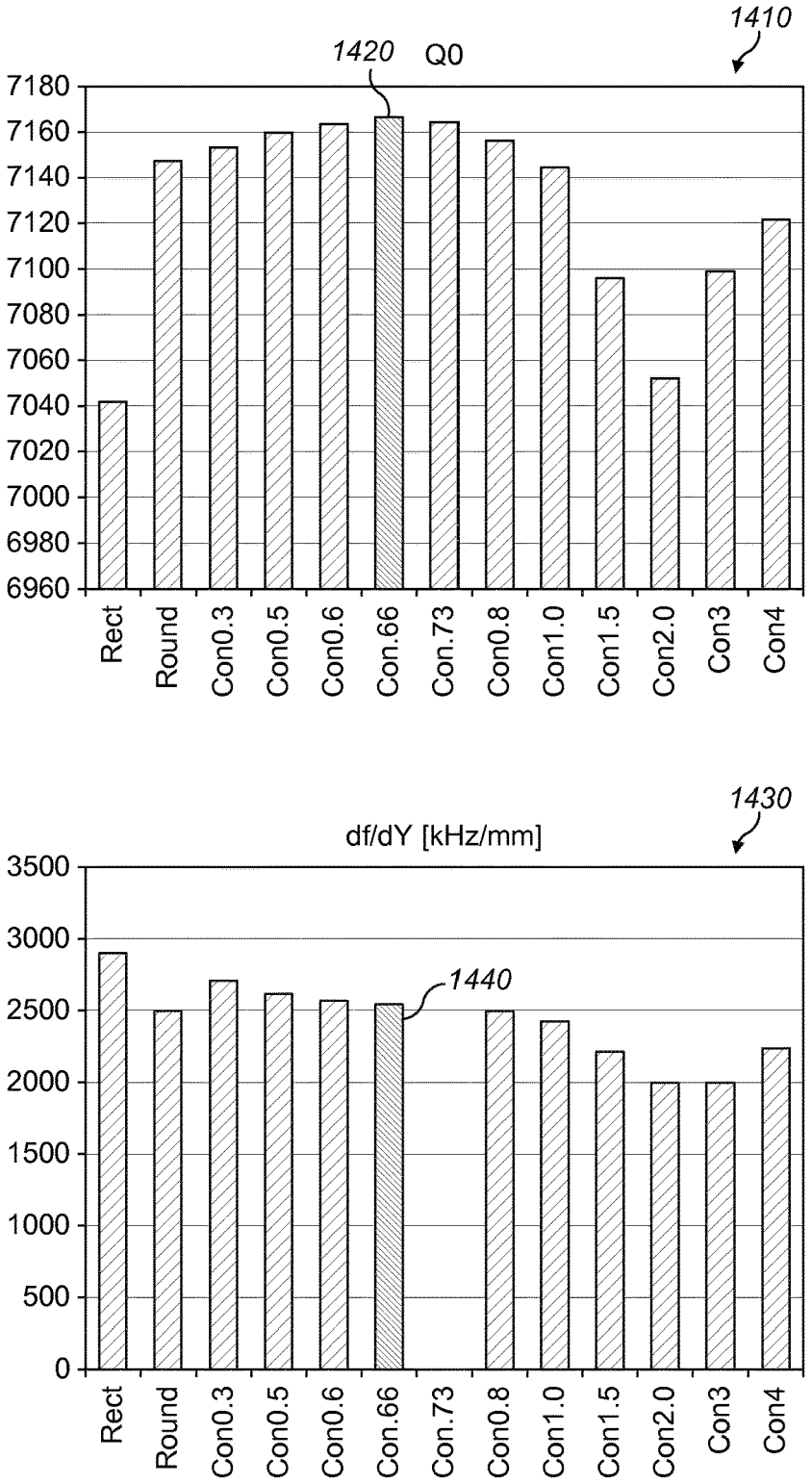
FIG. 14 shows comparisons of different tuner shapes and their respective Q0 and df/dY values.

FIG. 14 shows a comparison of the performance of different tuner shapes, from a simple rectangular head, to a rounded headed, through a range of different types of conical shapes. Graph 1410 shows how the Q-factor is affected by the different shapes, and it was found that the optimum shape was a ⅔ conical shape.

The sensitivity (i.e. change in frequency per displacement of tuner into the cavity) is also modelled in graph 1430. While conical shapes 2.0 and 3.0 represent the lowest sensitivities, they also correspond to very poor Q factors. Therefore, the best compromise between Q-factor and sensitivity appears to be the ⅔ conical tuner head. While the ⅔ conical tuner head is used in this example, other tuner head shapes could be chosen depending on other factors such as ease of manufacture or based on a higher preference for low sensitivities.

Figure 15:
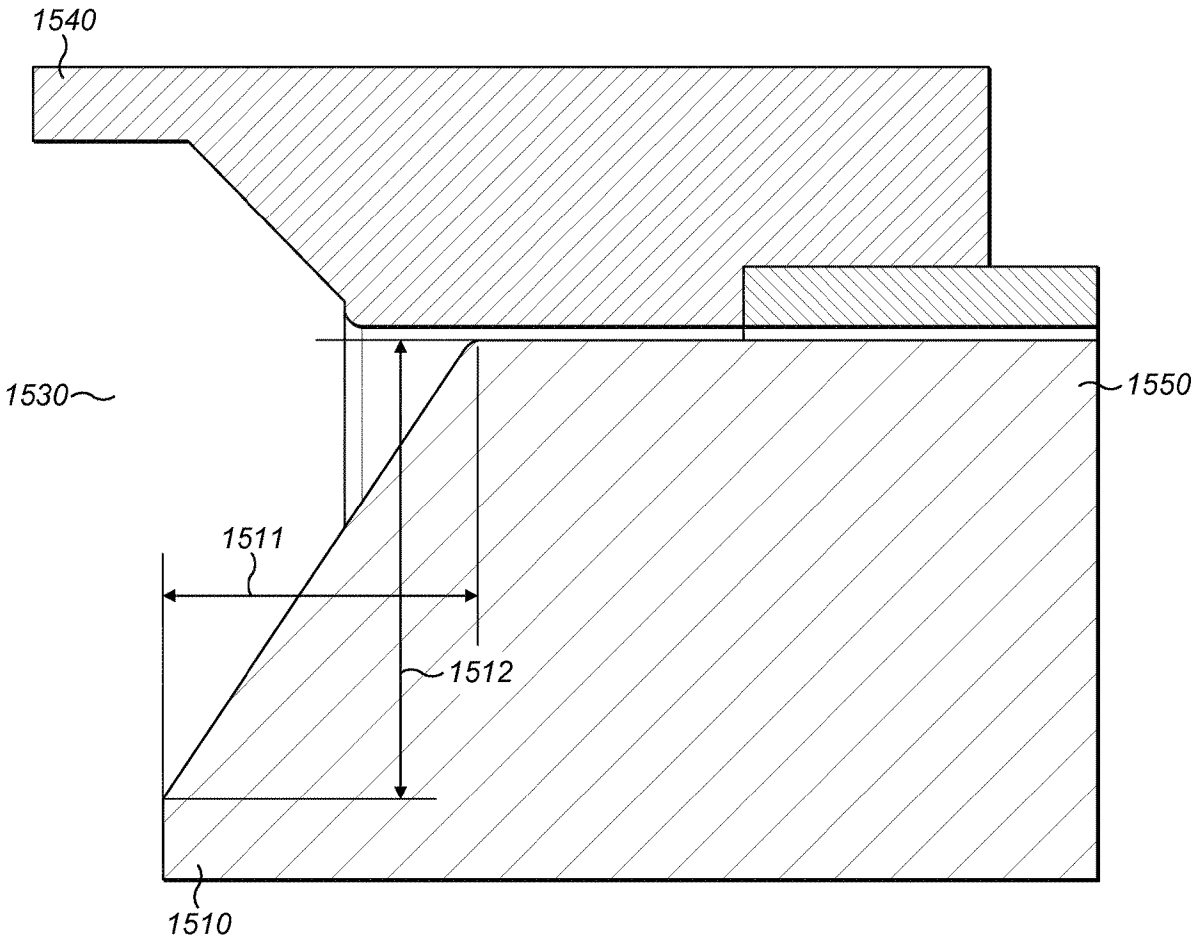
FIG. 15 is a diagram showing the dimensions of a ⅔ conical tuning shape.

FIG. 15 is a diagram showing the dimensions of a ⅔ conical tuning shape. The tuner head 1510 is shown protruding into the cavity 1530, and part of the vane 1540 is also illustrated for reference. The ratio of the conical height 1510 and the conical radius 1512 is shown to be ⅔. The end of the tuner 1550 may be accessible via a port on the RFQ and could be adjusted by turning a screw gauge, for example, to provide accurate control of the displacement within the cavity 1530.

Modularity

As shown in FIG. 1, separate RFQs can be coupled together to form a larger, higher energy RFQ system. Having adjacent RFQs separated by a 50 mm gap, for example, can result in limited beam losses at the gap as long as the phases of the two RFQs are independent of one another to ensure optimum matching. The cells at the transition may also need to be optimised to enable a lossless transition.

At a frequency of 750 MHz and a vane voltage of 80 kV, it is envisioned that a single 1.8 m RFQ could accelerate particles up to 5 MeV with a particle retention of 30%. A longer 2.4 m RFQ could accelerate particles up to 5 MeV with an increased retention of 38%, reflecting the additional cells available for a larger capture. Alternatively, two 1.4 m RFQs could be couple together with a 50 mm gap to achieve similar energies with similar losses.

Even more RFQs could be connected, for example, with three 1.2 m RFQs coupled with 50 mm gaps to produce 5 MeV particles with retentions as high as 90%. Therefore, a pair of 1.2 m RFQs could be used for a fast capture, but low efficiency acceleration, but a further 1.2 m RFQ could be easily added to improve the efficiency of the overall RFQ system if required.

Uses

The compact nature and potential modularity of the proposed RFQ apparatus allows for new and practical use cases.

The RFQ could be used as an injector for Hadrontherapy accelerators (Linac or other). In such a use case, a single RFQ made up of four modules could be used to accelerate protons to an energy of 5 MeV over 2 m. An RF power of about 400 kW would be required and the beam current would be less than 1 mA, as Hadrontherapy does not need a large throughput. Unlike competing cyclotron accelerators, for example, the proposed RFQ apparatus would not need bulky concrete shielding, allowing for it to fit in hospitals without using too much space.

The RFQ could be used for low cost production of SPECT (single photon emission computed tomography) isotopes. Two RFQs and another accelerator (such as a DTL) could be coupled together to produce a beam of protons with energies of 15 to 19 MeV over 7 m. With an RF power of 1400 kW, such a setup could allow beam current from 1 to 5 mA. It is envisioned that $^{99m}$Te could also be produced by striking $^{100}$Mo with a beam of accelerated protons to transmute the Molybdenum into Technetium by the $^{100}$Mo(p,2n)$^{99m}$Tc reaction. This is preferable to existing methods including large cyclotrons or the fission of $^{235}$U at nuclear power plants. The beam could be targeted at multiple targets for high current use.

The RFQ could be used for producing PET tomography isotopes such as $^{18}$F and $^{14}$C. By coupling two RFQs together into a 4 to 6 m length RFQ setup, 7-12 MeV protons can be emitted at a current of 1 to 5 mA with an RF power of 600 to 800 kW.

The RFQ could be used for $^{211}$Astatine production, as well as other targeted a-particle therapy. By producing a beam of a particles, the RFQ could produce $^{211}$At from the $^{209}$Bi(a,2n)$^{211}$At reaction. The a particles should be accelerated to above 20 MeV to enable the reaction, but the energy should be kept below 30 MeV so as to prevent the production of $^{210}$At, which typically decays to $^{210}$Po instead. Reaching these energies could be achieved by coupling two RFQs with another accelerator, such as a DTL.

The RFQ could be used for neutron production by accelerating deuterium at a heavy metal target. Two RFQs could be coupled together to accelerate the deuterium to 5 to 10 MeV at a beam current of 1 to 5 mA. The resulting neutrons could be subsequently used for Neutron Activation Analysis.

The RFQ could be used as an efficient way to cut silicon wafers by hydrogen implantation (i.e. a silicon ion cut). A single 2 m RFQ could be used to accelerate protons to energies of 0.2 to 1 MeV. Such a method of silicon ion cutting could be cost competitive against existing electrostatic accelerators.

The RFQ could also be used to facilitate IBA (Ion Beam Analysis). A single RFQ provides a very compact accelerator that can be used for analysis by PIXE (Proton Induced X-ray Emission), NRA (Nuclear Reaction Analysis), and RBS or ERDA. Protons or alpha particles could be accelerated to energies of 2.5 MeV and the energy spread could be reduced using a deflecting magnet and slits.

The RFQ could be used as an alternative to Tandem accelerators in Atomic Mass Spectroscopy by accelerating $^{14}C^{+}$ particles. Two RFQs could be coupled together to accelerate the carbon $^{14}C^{+}$ particles up to 4 to 5 MeV for use in carbon dating.

It is to be understood that the present disclosure includes permutations of combinations of the optional features set out in the embodiments described above. In particular, it is to be understood that the features set out in the appended dependent claims are disclosed in combination with any other relevant independent claims that may be provided, and that this disclosure is not limited to only the combination of the features of those dependent claims with the independent claim from which they originally depend.

The invention claimed is:

1. A compact radio-frequency quadrupole 'RFQ' accelerator for accelerating charged particles, the RFQ accelerator comprising:

a bunching section configured to have a narrow radio-frequency 'rf' acceptance such that only a portion of a particle beam incident on the bunching section is captured, and wherein the bunching section bunches the portion of the particle beam;

an accelerating section for accelerating the bunched portion of the particle beam to an output energy; and, a means for supplying radio-frequency power.

2. The RFQ accelerator of claim 1, wherein the bunching section is further configured to rapidly increase the synchronous phase of the particle beam incident of the bunching section.

3. The RFQ accelerator of claim 1, wherein the narrow rf acceptance is caused by the input of the bunching section having a synchronous phase of greater than −50 degrees, preferably greater than −40 degrees, and more preferably −30 degrees.

4. The RFQ accelerator of claim 1, wherein the bunching section is configured to increase the synchronous phase of the particle beam incident of the bunching section to between −25 and −15 degrees.

5. The RFQ accelerator of claim 1, further comprising a radial-matching section for transforming a particle beam incident on the matching section with a time-independent focalisation to a particle beam with a time-varying focalisation.

6. The RFQ accelerator of claim 1, wherein the bunching section is less than 40 cm in length, and preferably between 20 and 30 cm in length.

7. The RFQ accelerator of claim 1, wherein the means for supplying radio-frequency power comprises a plurality of radio-frequency power sources distributed along the RFQ accelerator.

8. The RFQ accelerator of claim 1, wherein the means for supplying radio-frequency power supplied power at a frequency of greater than 500 MHz, preferably between 700 MHz and 1 GHz.

9. The RFQ accelerator of claim 1, further comprising one or more adjustable tuners for adjusting magnetic field distributions, each of said adjustable tuners being adjustable by means of a screw gauge.

10. The RFQ accelerator of claim 9 wherein each said adjustable tuners have a tuner head with an at least partially conical shape, the partially conical shape having a rounded tip.

11. The RFQ accelerator of claim 10 wherein the partially conical shape has a height to radius ratio of between three-fifths and four-fifths, and preferably two thirds.

12. The RFQ accelerator of claim 1, wherein the RFQ accelerator is less than 6 m in length, preferably 5 m, and the output energy is at least 7 MeV, preferably between 10 MeV and 12 MeV.

13. The RFQ accelerator of claim 1, wherein the RFQ accelerator is less than 3 m in length, preferably 2 m, and the output energy is at least 4 MeV, preferably 5 MeV.

14. The RFQ accelerator of claim 1, wherein the RFQ accelerator comprises at least two resonant cavities, each of the at least two resonant cavities being separated from adjacent resonant cavities by a drift region between vanes.

15. The RFQ accelerator of claim 1, wherein the accelerated charged particles comprise any of one of protons, deuterons and alpha particles.

16. A method of accelerating charged particles using a compact radio-frequency quadrupole 'RFQ' accelerator, the method comprising:

capturing at a bunching section only a portion of a particle beam incident on the bunching section, wherein the bunching section is configured to have a narrow rf acceptance such that only the portion of the particle beam is captured;

bunching the portion of the particle beam at the bunching section;

accelerating at an accelerating section the bunched portion of the particle beam to an output energy; and, supplying radio-frequency power by a means for supplying radio-frequency power.

17. The method of claim 16, the method further comprising producing at least one of technetium, astatine and fluoride by accelerating charged particles at target substances using the RFQ accelerator.

* * * * *